United States Patent [19]

Allen

[11] Patent Number: 4,585,111

[45] Date of Patent: Apr. 29, 1986

[54] COIN SLIDE MECHANISMS

[75] Inventor: Kenneth R. Allen, Woodford Green, England

[73] Assignee: Essex Engineering Works (Wanstead) Ltd., Wanstead, England

[21] Appl. No.: 671,903

[22] Filed: Nov. 16, 1984

[30] Foreign Application Priority Data

Nov. 29, 1983 [GB] United Kingdom ..... 8331842

[51] Int. Cl.[4] ..... G07F 5/02

[52] U.S. Cl. ..... 194/257

[58] Field of Search ..... 194/55, 56, 57, 58, 194/59, 60, 1 E, 1 L, 92, 93, DIG. 12, 97 R

[56] References Cited

U.S. PATENT DOCUMENTS 3,605,974 9/1971 Hovorka ..... 194/55

*Primary Examiner*—Stanley H. Tollberg

*Attorney, Agent, or Firm*—Watson, Cole, Grindle & Watson

[57] ABSTRACT

In a manually operated coin slide mechanism, the usual coin receiving coin slide is permitted a full inward stroke regardless of the value or validity of the coin inserted therein. Actuation of an apparatus controlled by the mechanism is governed instead by a secondary slide yieldingly coupled to the coin slide, and whose displacement is dependent upon the value and validity of the coin. The mechanism is thus protected against damage resulting from the use of brute force by vandals, and is further readily adapted to accept coins of different values, since the degree of displacement of the secondary slide can be made dependent upon the coin value.

3 Claims, 5 Drawing Figures

COIN SLIDE MECHANISMS

This invention relates to coin slide mechanisms for controlling actuation of apparatus with which they are operatively associated in use, the mechanisms being of the type comprising a mounting body slidably supporting a coin slide having a coin aperture, the coin slide being manually displaceable inwardly of the mounting body to carry a coin (or equivalent token) past a succession of coin testing means. The coin is only accepted and the slide mechanism operable to release or actuate the apparatus if the coin satisfies all the tests imposed on it.

Such mechanisms are very widely used in conjunction with, for example, vending machines and laundry machines, and they need to be safeguarded in various ways against misuse, in particular by users being able to operate the associated apparatus without making proper payment, whether by use of a metal or other discs in place of coins, by recovering coins after operation of the device or by more sophisticated methods which it is preferred not to describe.

The tests applied by the various testing means are typically that the diameter and thickness are between closely defined limits, that the coin has no central aperture (such as a metal washer would have) and that it is not ferro-magnetic.

These tests are carried out at different points during inward travel of the slide and this travel is arrested if the coin fails any given test. This tends to invite maltreatment by vandals who frequently apply brute force to the slide in an effort to get it to complete its inward operating movement.

In accordance with the main characterising feature of the present invention, actuation of the apparatus is governed by predetermined minimum displacement of a secondary slide which is yieldingly coupled to the coin slide for movement therewith only to an extent permitted by operation of a stop device controlled by the testing means; and in that a full inward stroke of the coin slide is permitted by virtue of the yielding coupling, regardless of the extent of permitted movement of the secondary slide.

Thus, in the event of a spurious coin or token being inserted, movement of the secondary slide will be insufficient to secure operation of the apparatus, but the yielding coupling will permit full inward movement of the coin slide without damage to the mechanism.

Another drawback of the known slide mechanisms is that they cannot differentiate between coins of different values, but can only react by permitting a full stroke of the slide when the correct coin, (or selection of coins in the case of a multiple coin slide) is present.

However, in accordance with a preferred feature of the present invention, the stop device has a plurality of discrete operative positions corresponding to the respective values of different accepted coins, each said position corresponding to a different degree of operative displacement of the secondary slide, and the testing means are adapted to differentiate between different coins as each is located in the coin aperture.

Thus the mechanism is able to accept different coins singly or in various combinations, either to permit operation of the apparatus and actuate a change giving mechanism, or to operate a totalizer to effect actuation of the apparatus when a sufficient total value of coins has been inserted in succession.

One form of coin slide mechanism in accordance with the present invention will now be described by way of example, with reference to the accompanying drawings, in which.

Figure 1:
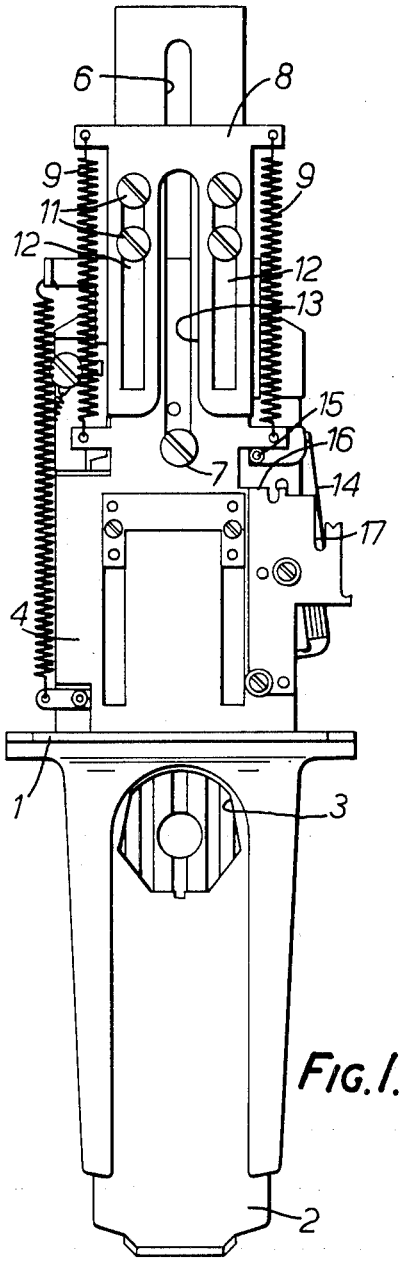
FIG. 1 is a plan view of the coin slide mechanism.

The mechanism comprises a body of die cast construction including an integral mounting flange 1 by which the mechanism is secured to support structure, such as the framework of a vending machine. The body is extended both forwardly and rearwardly of the flange and forms a sliding guide track for a coin slide 2 of generally known form, having an aperture 3 for the insertion of coins. The particular slide mechanism shown is adapted for operation by 50P, 10P and 5P coins.

In the interests of clarity, various testing means have been omitted from the drawings, but these include means for testing for washers and for ferro-magnetic coins, and for testing thickness and diameter of coins.

In contrast with the known mechanisms referred to above, the mechanism is designed to permit a full inward stroke of the coin slide 2, even if the coin (or token) fails any of the tests imposed upon it, or indeed if no coin or token is present. This characteristic reduces the temptation to use brute force on the coin slide, since it offers no great resistance to full inward travel.

Instead, the mechanism relies for its operating or releasing function upon displacement of a secondary slide 4 which is yieldingly coupled to the coin slide, but is latched against completion of its operating movement until the coin has passed the various tests imposed on it.

The coin slide 2 is urged outwardly relative to the body of the mechanism by a tension spring and has a set of ratchet teeth at its inner end for co-operation with a ratchet pawl, all in known manner.

The secondary slide 4 is supported above the upper surface of the coin slide and is guided for longitudinal sliding movement relative to the coin slide. It is formed with a longitudinal slot 6 which receives the shoulder of an abutment formed by a shoulder screw 7 fast with the coin slide.

Figure 1A:
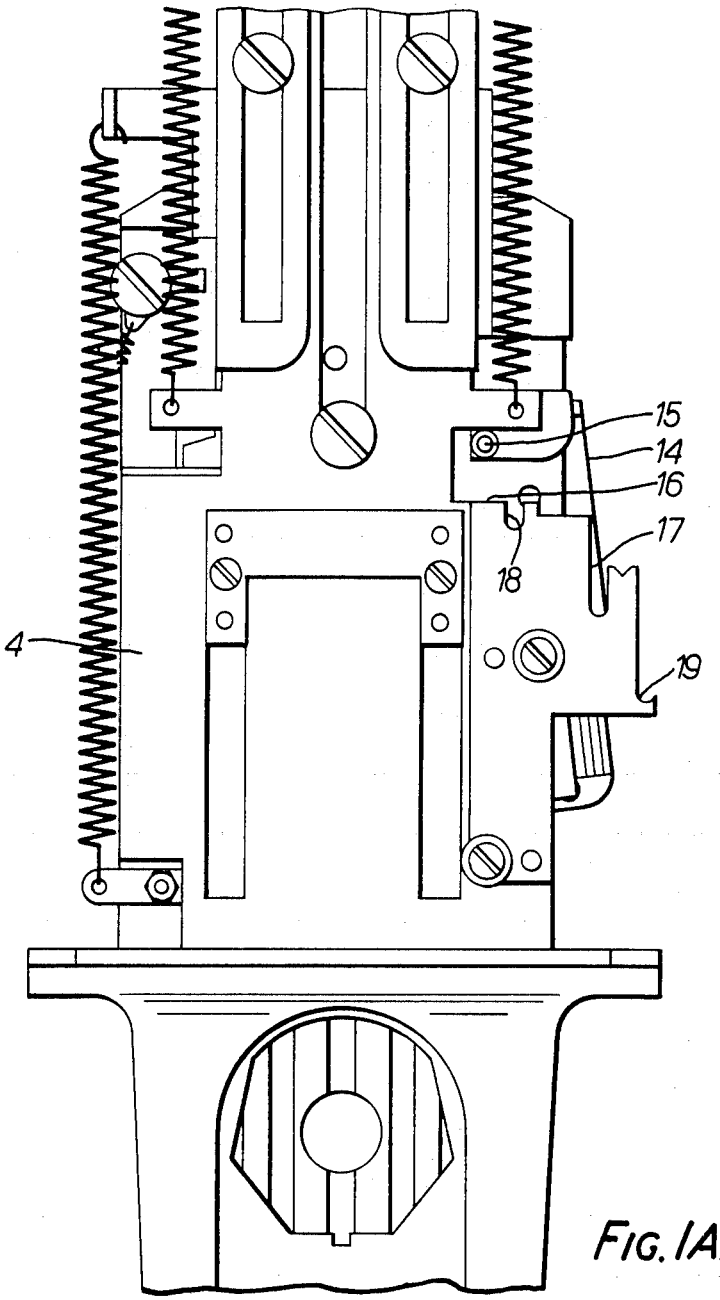
FIG. 1A is a detail from FIG. 1 on a larger scale.

An intermediate slide 8 is slidably mounted in turn on the secondary slide, to which it is coupled by tension springs 9 urging it outwardly, relative to the secondary slide. Longitudinal movement of the intermediate slide relative to the secondary slide is limited by four shoulder screws 11 secured to the secondary slide and engaging in longitudinal slots 12 formed in the intermediate slide. The screws 11 also provide for the location and sliding mounting of the slide 8 on slide 6. The intermediate slide is also formed with a central slot 13 aligned with the slot 6 of slide 8 so as to be engageable by the head of screw 7. Thus it will be seen that whenever the coin slide 2 is pressed inwardly from its starting position seen in FIGS. 1 and 1A, in the first position of travel, the abutment screw 7 moves along the slots 6 and 13 until it encounters the inner end of slot 13. Further movement is transmitted to the intermediate slide and the tension in springs 9 pull on the secondary slide, urging it to follow-up movement of the intermediate slide. However, only a small initial movement of the secondary slide will be permitted unless the coin has passed all the tests imposed on it.

Figure 2:
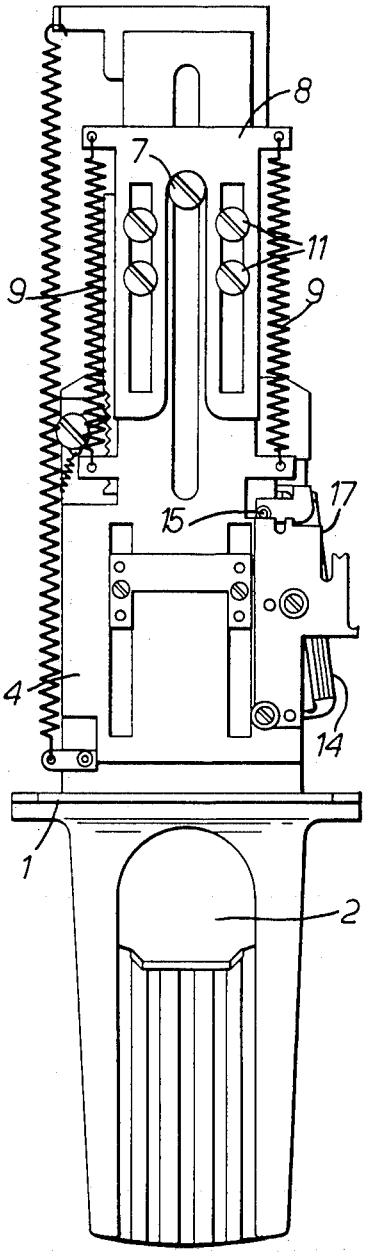
FIGS. 2, 3 and 4 are plan views of the mechanism in different stages of operation.

Operating movement of the secondary slide 4 is controlled by the position of a lever 14 pivotally mounted on the main body adjacent one side of the secondary slide, and carrying a stop pin 15 for co-operation in different operative positions with different co-operating portions 16, 17, 18, 19 of the secondary slide constituted by a shoulder and slots or notches set at different distances along the length of the secondary slide. The lever 14 normally occupies the position shown in FIGS. 1 and 2, in which the stop pin 15 is aligned with a shoulder 16 on the slide 4. With the lever in this position, the slide 4 can travel no further inwardly than its position in FIG. 2, which corresponds with the position in which the ratchet of the coin slide is engaged. This position of the lever 14 indicates that no coin is present, or that it is too small to displace the lever 14 sufficiently to permit further movement of the slide 4.

Figure 3:
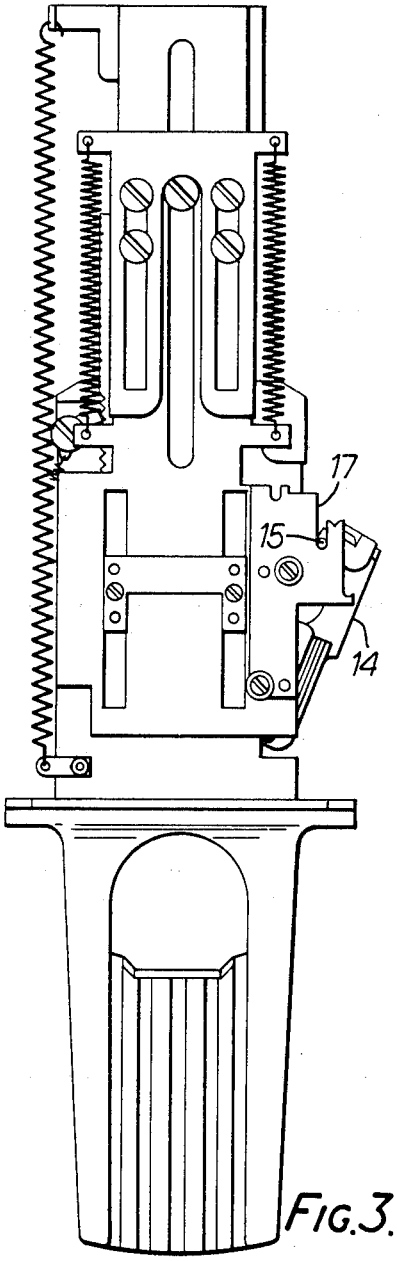

The lever 14 is pivotable in a clockwise direction, to move the stop pin 15 laterally, in the plane of the secondary slide, in response to the passage of a coin through the diameter testing means. In the example given, if a 10P coin is present, the lever is pivoted to the position shown in FIG. 3, in which the pin 15 is aligned with a slot 17 in the secondary slide, which is therefore able to move inwardly until the pin is encountered by the closed outer end of the slot 17, at which point the secondary slide is locked against further displacement.

Figure 4:
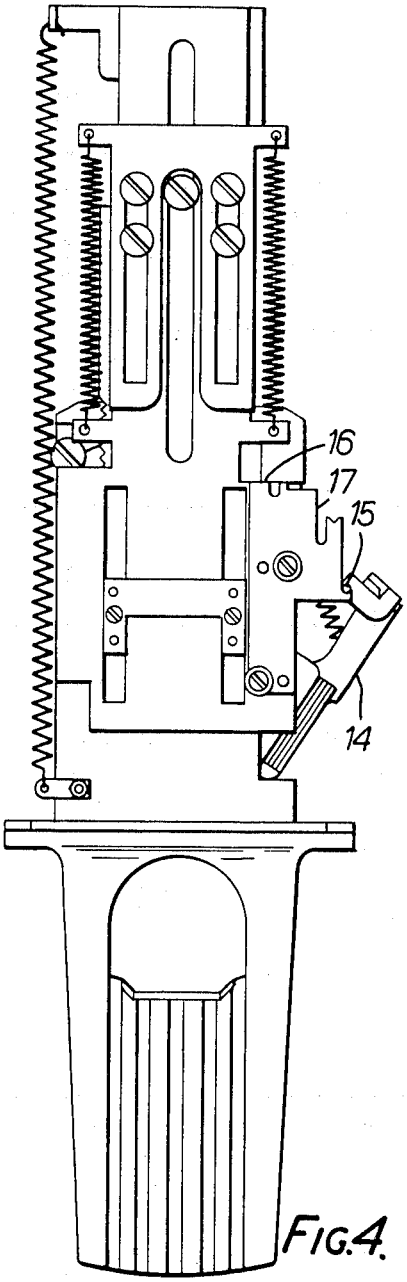

If a 50P coin is present, the lever will be displaced at a greater angle, as illustrated in FIG. 4, permitting a larger displacement of the secondary slide. In this case, the pin 15 is moved into alignment with a notch 19 on the outer edge of the secondary slide. A third slot 18 is provided to co-operate with the stop pin 15 when a smaller coin, say 2P or 5P is present.

In this manner, displacement of the secondary slide is made dependent upon the value of the coin in question and preferably, and as illustrated, the larger the value of the accepted coin the greater the displacement of the secondary slide. The mechanism can, of course, be designed to handle only one or two coins, or more than three different coins, subject to practical limitations imposed by the differences in diameter of the selection of coins in question.

Displacement of the secondary slide can be employed to actuate, or release, the apparatus under control either by direct mechanical actuation, or indirectly by employing the displacement to operate e.g. limit switches and/or solenoids. For example, the secondary slide may carry an electrical contact arranged to co-operate with a series of fixed contacts arranged alongside the slide. Bridging of the respective fixed contacts may of course be employed to actuate respective solenoids or equivalent electro-mechanical devices, or to generate pulsed signals fed to a totalizer.

In some applications, a succession of coins may be required to operate or release an apparatus. For example, in the case of a coin-operated clothes washing machine, a price of, say, 80 pence may be charged. In such a case a suitable form of totalizer is required to count the total value of the coins inserted before the machine can be started. It is also useful to be able to use the mechanical output of the slide mechanism to operate the starter switch. In such a case, the coin slide 2 can be used to press the starter button each time the slide is pressed fully inwardly, but starting can be delayed by holding open a solenoid operated switch in series with the starter switch until the totalizer confirms full payment to actuate the solenoid.

Many other modes of control employing the displacement of the secondary slide will, of course, be possible within the scope of the present invention.

I claim:

1. A coin slide mechanism for controlling actuation of an apparatus, said mechanism comprising:

a mounting body;

a coin slide mounted for sliding movement along a rectilinear path between a first, outer position and a second, inner position, said coin slide having a coin aperture to receive any single coin from a selected range of coins of different values said coin slide being manually displaceable from said first position to said second position to carry a coin present in said coin aperture past coin testing means for testing the value of said coins;

a secondary slide for actuating said apparatus and yieldingly coupled to said coin slide for movement therewith;

movable stop means operatively coupled to said coin testing means and displaceable thereby to one of a number of discrete operative positions each corresponding to the particular value of the coin in said coin aperture, said stop means co-operating with said secondary slide to arrest movement thereof at a position corresponding to the value of said coin, whereby said coin slide is manually displaceable from said first position to said second position regardless of the value of a coin present in said coin aperture and displacement of said secondary slide with said coin slide is arrested at a position corresponding to the value of said coin.

2. A coin slide mechanism for controlling actuation of an apparatus, said mechanism comprising:

a mounting body;

a coin slide mounted for sliding movement along a rectilinear path between a first, outer position and a second, inner position, said coin slide having a coin aperture to receive said coin slide being manually displaceable from said first position to said second position to carry a coin present in said coin aperture past coin testing means for testing the validity of said coin;

a secondary slide for actuating said apparatus and yieldingly coupled to said coin slide for movement therewith;

movable stop means operatively coupled to said coin testing means and displaceable thereby to an operative position, said stop means co-operating with said secondary slide to arrest movement thereof at a position corresponding to the value of said coin, whereby said coin slide is manually displaceable from said first position to said second position regardless of the validity and value of a coin present in said coin aperture, and displacement of said secondary slide with said coin slide is arrested at a position corresponding to the value of said coin.

3. A coin slide mechanism as claimed in claim 1, wherein said secondary slide has a plurality of abutment surface portions thereon spaced apart laterally of said secondary slide, and said moveable stop means is displaceable laterally by said coin testing means to register with a given one of said surface portions, in accordance with the value of the coin present in said aperture.

* * * * *